US007029345B1

(12) United States Patent
De Mange

(10) Patent No.: US 7,029,345 B1
(45) Date of Patent: Apr. 18, 2006

(54) PREVENTIVE THEFT INSTALLATION ON A BOAT

(76) Inventor: Craig De Mange, 1031 Logan Blvd., Naples, FL (US) 34116

( * ) Notice: Subject to any disclaimer, the term of this patent is extended or adjusted under 35 U.S.C. 154(b) by 0 days.

(21) Appl. No.: 11/014,601

(22) Filed: Dec. 17, 2004

(51) Int. Cl.
*B63H 5/125* (2006.01)
*B63H 20/08* (2006.01)

(52) U.S. Cl. ..... 440/57; 440/900

(58) Field of Classification Search ..... 440/900, 440/57; 70/159
See application file for complete search history.

(56) References Cited

U.S. PATENT DOCUMENTS 4,058,994 A * 11/1977 Coppola ..... 70/232
4,228,983 A * 10/1980 Bowman, Jr. ..... 248/553
4,502,306 A * 3/1985 Scammacca ..... 70/159
5,960,653 A * 10/1999 DeWalch et al. ..... 70/164
6,726,515 B1 * 4/2004 DeMange ..... 440/113

* cited by examiner

*Primary Examiner*—Stephen Avila

(57) ABSTRACT

The invention pertains to a theft preventive installation on a boat. Particularly, it is directed to prevent a theft of the drive for the boat at its connection to a housing containing the drive shaft from the motor. It is commonly known that up to six bolts connect the drive to the housing. This particular connection is prone to be broken by unscrewing the bolts whereby the drive can easily be removed from the housing and thereby from the boat. According to the invention, the view of the bolts is obstructed whereby any application of tools to the bolts is prevented. In most installations, there are four bolts placed in a pattern with two bolts each on each side of the upper section of the drive. A plate having inwardly facing flanges thereon is placed under the bolts of each side of the drive. This will securely fasten the plates under the bolts. A third plate having a three-dimensional shape is placed over the ends of the two plates and is spanning the distance between the two plates, A lock bolt passes through the two plates and parts of the third plate. This then prevents the bolts from being viewed and any tools from being applied to the bolts or nuts on the bolts.

9 Claims, 2 Drawing Sheets

PREVENTIVE THEFT INSTALLATION ON A BOAT

BACKGROUND OF THE INVENTION

The present invention pertains to a theft prevention device on drive installations on a boat. Many drive installations in a boat involve either an outboard motor or in inboard motor. The present device is directed to an inboard installation. In an inboard installation, the motor is mounted within the boat hull in a substantially linear alignment with the boat hull. The motor has a drive shaft extending to the rear of the boat and ends behind the transom of the boat. The drive shaft has a bevel gear which will mesh with the bevel gear of a downward shaft and then to the propeller gear so as to divert the drive of the motor to a different direction that is downwardly and then outwardly below the water line. This gearing is contained in one unit and is known as the drive of the boat and this particular drive is prone to theft because it is mounted behind the transom of the boat on a housing which contains the drive shaft and can easily be removed from the housing just by removing a few bolts. The bolts include at at least six bolts having nuts thereon. The bolts are arranged on each side of the drive in a certain pattern. Four bolts are arranged at an upper section of the drive with two bolts each being placed on each side of the drive in a parallel pattern. The remaining two bolts of the six bolts are arranged at a lower section of the drive with one bolt each on each side of the drive. These bolts or the nuts thereon are readily visible and available to a prospective felon trying to steal the drive from the motor of the boat by simply removing the above noted bolts and nuts. Insurance companies are well aware of this weakness in the mounting of motor and drive mounts in a motor boat and would greatly appreciate any device that would prevent the above noted theft.

OBJECTS OF THE INVENTION

An object of the invention is to conceal and to prevent the accessibility of some of the bolts that are mounting the drive of the boat to the housing containing the drive shaft of a boat to prevent their removal and thereby the theft of the drive. Of particular interest are the four bolts in the upper section of the drive that are arranged in pairs on each side of the drive. As mentioned above, these bolts fasten the drive of the boat to a housing containing the drive shaft of the motor. The inventive device completely blocks the view of the four bolts and thereby prevents any access to them. The remaining 2 bolts are left alone because if the four bolts that are concealed cannot be removed, the two bolts alone will not allow the drive to be removed.

DETAILED DESCRIPTION OF THE INVENTION

Figure 1:
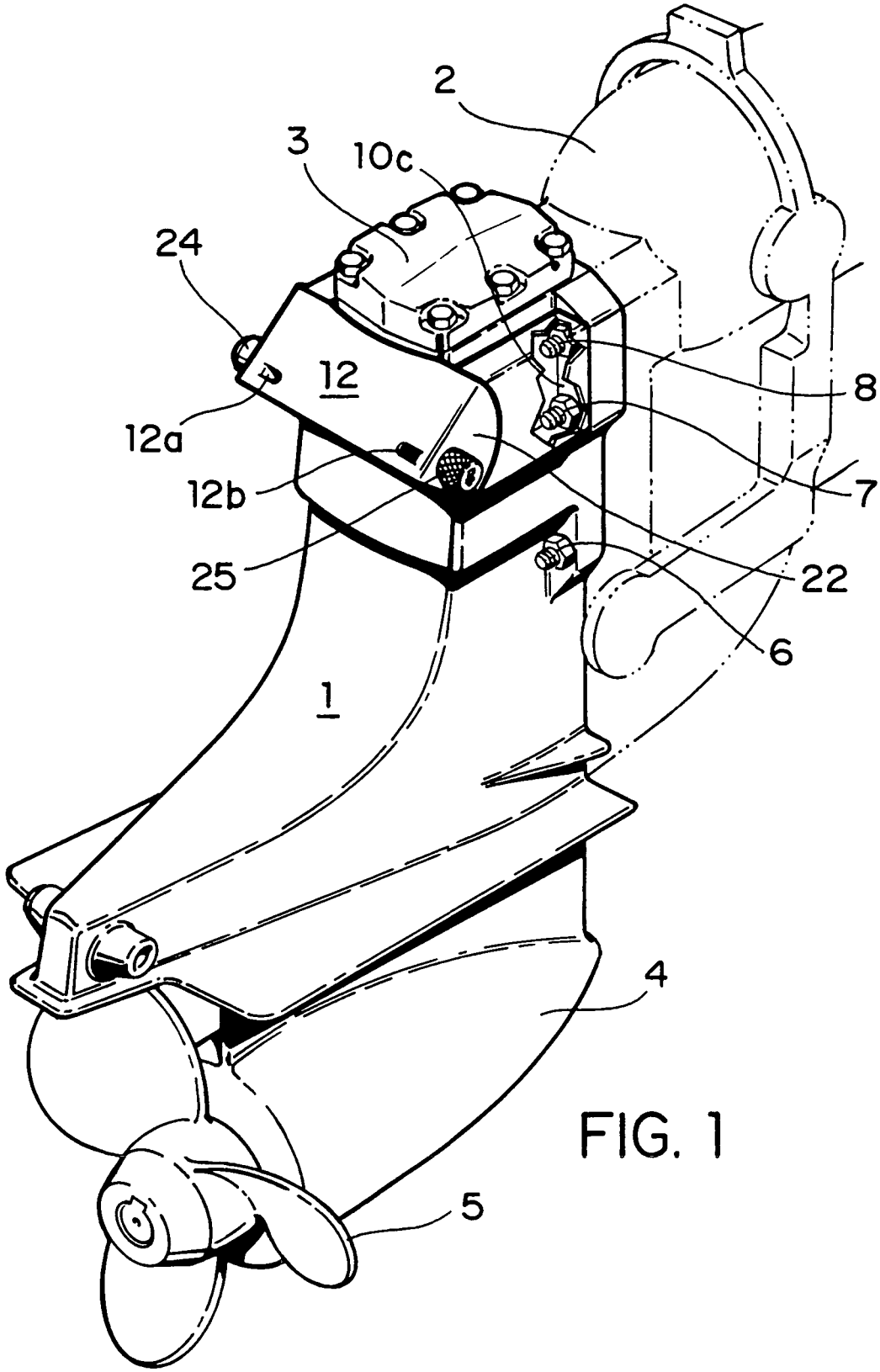
FIG. 1 is a perspective view of the drive bolted to the drive shaft housing.

Turning now to FIG. 1, there is shown a drive 1 for the boat and how it is mounted by bolts 7 an 8 to housing 2 containing the drive shaft from the motor (not shown). The drive itself has an upper section 3 and a lower section 4 operating the propeller 5. Below the upper section 3 there are located two bolts 6 (one on each side) which aid in mounting the drive 1 to the housing 2. The two bolts 7 and 8 with two more bolts (not shown) on the other side of the upper section 3 form a pattern of four bolts with two bolts parallel to each other on each side of the upper section. This pattern of four bolts on the section 3 is obscured from view and, therefore, any tools cannot be attached to these nuts on the bolts to loosen and to remove the same. In FIG. 1, there is shown a broken away flange 10*c* (FIG. 2) under the nuts 7 and 8 on the upper section of the drive 2. This flange will now be explained with reference to FIG. 2.

Figure 2:
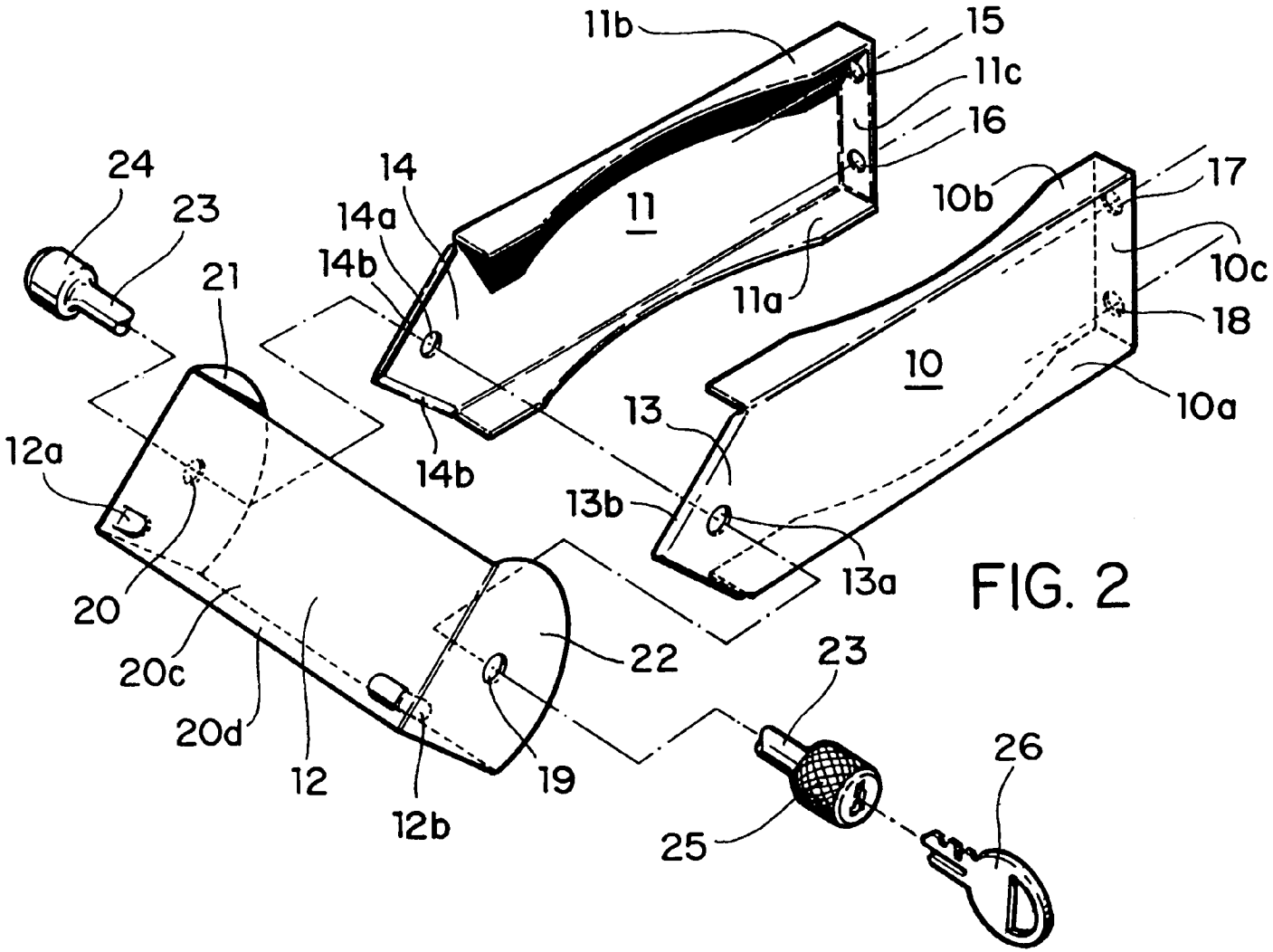
FIG. 2 is an exploded view of the locking mechanism of the invention.

FIG. 2 shows the inventive lock system in an exploded view. On each side of the upper section 3 of the drive 1, there are provided two plates 10 and 11 on each side of the upper section 3 of the drive 1. The two plates 10 and 11, one 10 on the side visible in FIG. 1 and the other plate 11 (not visible in FIG. 1) have a short flange 10*c* and 11*c*, respectively. The flanges 10*c* and 11*c* have bore holes 17 and 18 in flange 10*c* and bore holes 15 and 16 in flange 11*c*. These bore holes are designed so that these plates can be fastened under the nuts 7 and 8 when the drive 2 is fastened to the housing 2. Of course, the holes 15 and 16 on the flange 11*c* of side plate 11 (not shown) on the other side of the drive 1 are fastened by the nuts on that side. The side plates themselves are made of stainless steel and a heavy gauge to resist rust, distortion or bending under a force applied to the plates. The plates 10 and 11 have further reinforcements by longitudinal flanges 10*a*, 10*b*, and 11*a* and 11*b*, respectively. These flanges further aid in reinforcing the two-dimensional stability of the plates 10 and 11 in strength and from demolition while obscuring any sight of the bolts 7 and 8. The plates 10 and 11 are mounted at a rearward end by the bolts 7 and 8 and the plates have at their forward ends triangular portions or configurations 13 and 14, respectively, including an angle of 90°. The triangular portions 13 and 14 have through bores 13*a* and 14*a*. Also the triangular portions 13 and 14 have flanges 13*b* and 14*b*, respectively, which again aid in reinforcing the front portions 13 and 14 of the plates 10 and 11. The triangular front portions 13 and 14 of the plates 10 and 11 each also receive a through bore 13*a* and 14*a* therethrough to accommodate a lock bolt 23. Once the side plates 10 and 11 are installed under the lock nuts 7 and 8 with the flanges 10*c* and 11*c* facing inwardly toward the upper portion 3 of the housing 1, the three-dimensional plate or configuration 12 is placed over the triangular portions 13 and 14 of the plates 10 and 11. Thereby, the through bores 13*a*, 14*a* of the side plates 10 and 11 and the through bores 19 and 20 of the side plates 21 and 22 will lineup to receive the locking bolt 23, which will pass through all of the through bores 19, 13*a*, 14*a* and 20. The locking bolt 23 has at one end thereof an enlarged head 24 while the other end of the locking bolt 23 will receive a lock head 25 which can only be operated by a key 26 to unlock the lock head from the bolt 23. The outer cover plate 12 is shown in a three-dimensional configuration. In this configuration, there are two plates 20*c* and 20*d* that are placed at an angle of 90° relative to each other and fastened to each other as a unit and the end plates 21 and 22 complete the three-dimensional configuration. Once the plate 12 is placed over the free ends 13 and 14 of the side plates 10 and 11, the inventive lock is now completed because the lock nuts 7 and 8 cannot be seen anymore and no tools can be applied to the nuts 7 and 8. The lock bolt 23 combines all the parts into one unit. The bolt 23 has on one end thereof an enlarged head 24 so that it cannot pass through any of the holes 20, 14*a*, 13*a* and 19. If the drive 1 has to be removed for any reason from the housing 2, it suffices to operate the key 26 in the lock 25 to remove the lock 25 from the lock bolt 23 and when the lock bolt 23 is removed from the various parts, the bolts 7 and 8 are exposed by removing the three-dimensional configuration 12 from the free ends 13 and 14 and respective tools can be used to remove the drive 1 from the respective housing 2 because the bolts 7 and 8 are now exposed. Of course, this is true also for the respective other two bolts (not shown) on the other side of the drive 1.

Attention is now directed to both FIGS. 1 and 2 and to the reference characters 12*a* and 12*b*. They represent stops for the side plates 10 and 11 so that when they are installed within the cover plate 12 (three-dimensional), the side plates 10 and 11 cannot move inwardly any more to disturb the three-dimensional configuration of the cover plate 12 and the side plates 10 and 11. The stops 12*a* and 12*b* can take many different forms. Thus, they can take the form of a nut and a bolt or the form of a welding deposit on the plates or a struck-out portion in the material itself. It should be noted that the 90° angles previuosly described are the preferred angles because the 90° angles give the most strength to the elements involved. An angle more or less than 90° may also be used.

CONCLUSION

In view of all of the above, it can now be seen that a valuable contribution has been made to the art of boats in that the drives of the boats are being protected from theft. The plates are made from stainless steel and a heavy gauge material so that this material is virtually indestructible. Any force exerted on any of the edges of the plates by chisels, crow bars or sledge hammers results in damage to the drive itself because the casing of the drive is made of a rather brittle material. While this results in loss of the drive, it will also be a deterrent to theft because it renders the use of the drive to be useless for the thief.

I claim:

1. A preventive theft installation on a boat, said boat having an inboard motor installed in the hull of the boat including a drive shaft extending through a transom of said boat into a housing, a drive having an upper section and a lower section, said upper section has means for bolting said upper section to said housing, said lower section is driving a propeller of said boat, said means for bolting includes at least four bolts with a pair of bolts each placed on opposite sides of said upper section of said drive, plate means attached to said bolts for obscuring a view of said bolts and at the same time preventing any application of tools to said bolts including a lock bolt passing through said plate means.

2. The preventive theft installation of claim 1, wherein said plate means includes at least two rectangular plates having flanges thereon, said flanges facing inwardly toward said upper section of said drive, each of a shorter side of said rectangular plates and at one end thereof having said flange thereon is mounted to said drive by said bolts, a third plate is mounted in front of said upper section of said drive and is in locked contact with each of the other ends of said at least two plates.

3. The preventive theft installation of claim 2, wherein each of the other ends of said at least two plates is of a triangular shape including an angle of 90° facing outwardly from said drive.

4. The preventive theft installation of claim 3, wherein said third plate is constructed in a three dimensional shape including two plates that span the distance between said at least two plates, said two plates are secured perpendicular to each other including an angle of 90°.

5. The preventive theft installation of claim 4, wherein end plates are connected to each of said two plates that are secured to each other, each of said end plates includes an angle of 90° and is secured within the 90° angle of said two plates.

6. The preventive theft installation of claim 5, wherein said three dimensional third plate is fitted over said at least two plates at said ends having the 90° angle thereon.

7. The preventive theft installation of claim 6, wherein said said lock bolt passes through a hole in one of said end plates, a hole in one of said at least two plates, a hole in the other of said end plates and through a hole in the other of said at least two plates.

8. The preventive theft installation of claim 6 including means for preventing said at least two from moving toward each other once said three dimensional third plate is fitted over said ends of said at least two plates.

9. The preventive theft installation of claim 7, wherein said lock bolt has an enlarged head on one end thereof and a key operated lock at the other end thereof.

* * * * *